United States Patent [19]

Abe et al.

[11] Patent Number: 4,754,729

[45] Date of Patent: Jul. 5, 1988

[54] CAMSHAFT SUPPORT ASSEMBLY FOR VALVE OPERATING MECHANISM IN AN INTERNAL COMBUSTION ENGINES

[75] Inventors: Hiroshi Abe; Yutaka Koinuma; Toshinari Sonoda; Kazuo Yoshida; Akira Fujiwara, all of Saitama, Japan

[73] Assignee: Honda Giken Kogyo Kabushiki Kaisha, Tokyo, Japan

[21] Appl. No.: 917,719

[22] Filed: Oct. 10, 1986

[30] Foreign Application Priority Data

Oct. 11, 1985 [JP] Japan ..... 60-224837
Oct. 21, 1985 [JP] Japan ..... 60-233472
Oct. 21, 1985 [JP] Japan ..... 60-234700

[51] Int. Cl.[4] ..... F01M 9/10

[52] U.S. Cl. ..... 123/90.38; 123/90.34; 123/193 H

[58] Field of Search ..... 123/90.27, 90.33, 90.34, 123/90.37, 90.38, 90.39, 193 H, 195 H; 184/6.5, 6.8, 6.28

[56] References Cited

U.S. PATENT DOCUMENTS 3,412,720 11/1968 Binder ..... 184/6.5
4,291,650 9/1981 Formia et al. ..... 123/193 H
4,430,968 2/1984 Futakuchi et al. ..... 123/90.27
4,612,885 9/1986 Yoshikawa ..... 123/90.27

*Primary Examiner*—Willis R. Wolfe, Jr.
*Assistant Examiner*—M. Macy
*Attorney, Agent, or Firm*—Lyon & Lyon

[57] ABSTRACT

An overhead camshaft in an engine is rotatably supported by a camshaft support assembly comprising a plurality of bearing bases, a plurality of cam holders mounted on the bearing bases, respectively, and a rigid frame mounted on the cam holders and interconnecting them. The bearing bases and the cam holders jointly define a plurality of bearing surfaces by which the camshaft is rotatably supported. The cam holders may be integrally interconnected by side walls joined to opposite ends of the cam holders. The rigid frame includes an internal longitudinal oil pipe for ejecting lubricating oil onto cam surfaces of the camshaft. The bearing bases and the rigid frame may be made of an aluminum alloy, whereas the cam holders may be made of cast iron. Each of the cam holders has an oil supply port opening into one of the bearing surfaces at a position such that the lubricating oil will be supplied fully around the journal of the camshaft which is rotatably supported by the bearing surface.

16 Claims, 10 Drawing Sheets

FIG. 8.
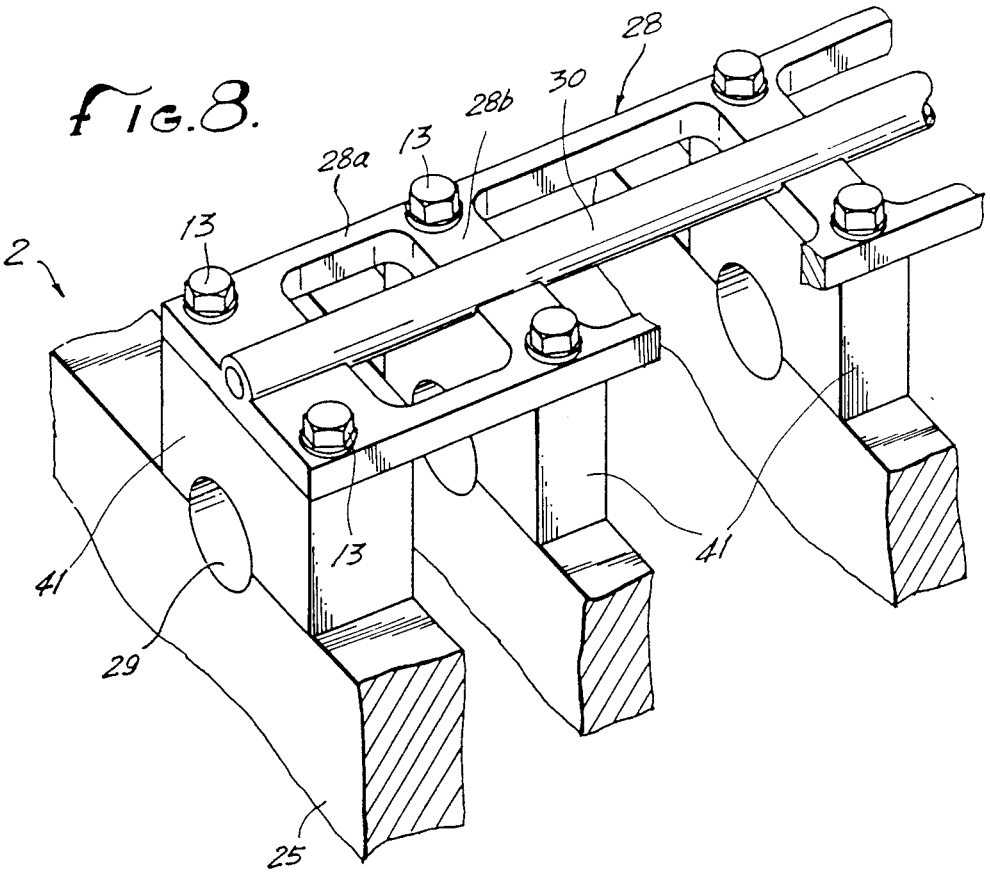
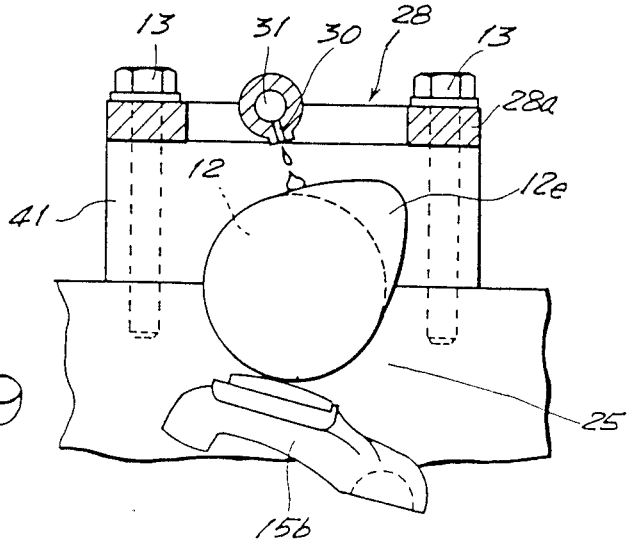
FIG. 9

CAMSHAFT SUPPORT ASSEMBLY FOR VALVE OPERATING MECHANISM IN AN INTERNAL COMBUSTION ENGINES

The present invention relates to a camshaft support assembly which supports an overhead camshaft of a valve operating mechanism in an internal combustion engine.

Generally, overhead camshafts of valve operating mechanisms in internal combustion engines are rotatably supported by a camshaft support assembly comprising a plurality of parallel, spaced bearing bases mounted on an upper surface of a cylinder head and supporting a lower peripheral surface of the camshaft and a plurality of parallel, spaced cam holders mounted on the upper surfaces of the bearing bases and supporting an upper peripheral surface of the camshaft. The bearing bases and the cam holders jointly constitute camshaft bearings. The cam holders are independent of each other and detachably secured to the respective bearing bases by means of bolts.

Each of the cam holders is generally in the form of a plate vertically mounted on the bearing base and has a relatively small thickness because of limitations on the overall length of the engine. During operation of the engine, the independent cam holders tend to be displaced out of mutual coaxial alignment under varying loads on the camshaft, oscillating rotation of the camshaft, thermal deformations of the cylinder head, and other stresses, thus failing to allow the camshaft to be smoothly rotated.

One known type of internal combustion engine which has recently been used on many automobiles includes four valves, i.e., a pair of intake valves and a pair of exhaust valves, in each combustion chamber or cylinder, the valves being controlled by a single camshaft rotatably supported by bearing bases and cam holders. In such an engine, reactive forces applied to the camshaft are large, and to prevent the camshaft from oscillating in its rotation, the cam holders or the cylinder head must be very rigid. However, the aforesaid camshaft support assembly fails to render the cam holders and the cylinder head rigid enough to avoid all of the undesirable camshaft behavior.

Japanese Laid-Open Patent Publication No. 57 (1982)200648 proposes a camshaft support assembly in which the upper portions of the cam holders are interconnected by a rigid member such as a beam extending across the cam holders. The beam increases the rigidity of the cam holders for greater resistance to bouncing of the valves. A similar arrangement with two beams is disclosed in U.S. Pat. No. 4,438,734.

In the valve operating mechanisms in the engine, another problem is that the cam surfaces of the camshafts require lubrication by lubricating oil. The lubricating oil may efficiently be supplied to the cam surfaces from an oil pipe extending above the camshaft and parallel thereto. The oil pipe may double as a rigid member or beam interconnecting the cam holders, so that the cam holders can be stiffened by the oil pipe while the cam surfaces can efficiently be lubricated by the lubricating oil ejected from the oil pipe.

However, with such an arrangement, the oil pipe is positioned as the rigid member centrally on the upper portions of the cam holders, which makes it difficult for the camshaft bearings to be machined. More specifically, the camshaft bearings must be finished highly accurately and held in exactly coaxial alignment with each other for allowing smooth rotation of the camshaft. It has been customary to finish the camshaft bearings with a long tool such as a reamer extending through the camshaft support assembly from one end thereof, and to employ intermediate bushings, inserted from above between the cam holders to guide the long tool between the cam holders that are spaced relatively widely from each other. If the oil pipe is disposed centrally on the upper portions of the cam holders, however, the intermediate bushings cannot be inserted between the cam holders, and it would be extremely difficult to finish the camshaft bearings.

According to another camshaft lubricating device disclosed in Japanese Laid-Open Patent Publication No. 60 (1985)-35106, oil supply ports are defined in bearing bases mounted on a cylinder head and open at bearing surfaces of the bearing bases on which a camshaft is rotatably mounted. When a valve is lifted off its valve seat, the camshaft is pressed under reactive forces against bearing surfaces of cam holders mounted respectively on the bearing bases. Since the oil supply ports open at the bearing surfaces of the bearing bases, the lubricating oil from the oil supply ports cannot sufficiently be fed to the zone where the camshaft is pressed against the bearing surfaces of the cam holders.

In some internal combustion engines, the cylinder head and the cam holders are made of an alloy of aluminum having a relatively low modulus of elasticity. In constructions where hydraulic lash adjusters are employed in a valve operating mechanism to operate an increased number of valves per cylinder at a high speed, increased loads are applied by the hydraulic lash adjusters via the camshaft to the camshaft bearings, thus subjecting the cam holders to elastic deformation. Further, because an aluminum alloy has a greater coefficient of thermal expansion than cast iron of which the camshaft is made, the cam holders expand to a greater degree than the camshaft when the cylinder head is heated to a high temperature during operation of the engine. The camshaft support assembly made of an aluminum alloy therefore has the disadvantage that while the engine is in operation, the camshaft bearings expand out of coaxial alignment with each other, causing noise and making the camshaft support assembly less durable.

SUMMARY OF THE INVENTION

It is an object of the present invention to provide a camshaft support assembly which increases the rigidity of the cam holders and cylinder head, allows efficient lubrication of the cam surfaces of a camshaft, and presents no obstacle to the finishing of the camshaft bearing surfaces.

Another object of the present invention is to provide a camshaft support assembly having means for sufficiently lubricating journals of a camshaft which are rotatably supported in camshaft bearings.

Still another object of the present invention is to provide a camshaft support assembly including cam holders of increased rigidity such that the cam holders are subject to reduced elastic deformation and thermal expansion during operation of an engine in which the camshaft support assembly is incorporated.

According to the present invention, there is provided a camshaft support assembly for supporting an overhead camshaft of a valve operating mechanism in an engine, comprising a plurality of parallel, spaced bearing bases, a plurality of parallel, spaced cam holders mounted respectively on the bearing bases, the bearing bases and the cam holders jointly defining an array of bearing surfaces for rotatably supporting the overhead camshaft, and a rigid frame detachably mounted on the cam holders and interconnecting the cam holders, the rigid frame including an integral oil pipe extending along the array of bearing surfaces for ejecting lubricating oil toward cam surfaces of the overhead camshaft. Since the cam holders are securely interconnected by the rigid frame including the oil pipe, they are very rigid in the direction of the axis of the camshaft. With the rigid frame mounted on the cam holders, the oil pipe is disposed over the camshaft for efficiently lubricating the cam surfaces of the camshaft.

Another feature of the present invention is that for finishing the bearing surfaces during the manufacture of the camshaft support assembly, a dummy frame without any oil pipe is attached to the cam holders and an intermediate bushing is inserted downwardly through the dummy frame into a position between two adjacent cam holders to guide a finishing tool while the finishing tool is finishing the bearing surfaces successively.

A further feature of the present invention is that the camshaft support assembly may also include side walls integrally joined to opposite ends of the cam holders for a higher degree of integrity of the cam holders. The bearing bases and the rigid frame are made of an aluminum alloy, and the cam holders are made of cast iron whereby the cam holders are subject to less elastic deformation and less thermal expansion during operation of the engine.

Still another feature of the present invention is that the lubrication of the camshaft bearing surfaces is provided by an oil supply port opening into the upper bearing surface formed by the cam holder and upstream of a position in which the camshaft is slidingly pressed against the upper bearing surface under the resiliency of the valve springs, with respect to the direction in which the camshaft rotates about its own axis whereby the lubricating oil adequately lubricates the entire circumferential surface of the journal of the camshaft for smooth and stable rotation thereof.

The above and other objects, features and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 8 is a fragmentary perspective view of a modified camshaft support assembly according to the present invention;

FIG. 9 is a fragmentary vertical transverse cross-sectional view of the camshaft support assembly shown in FIG. 8;

DESCRIPTION OF THE PREFERRED EMBODIMENTS

Figure 1:
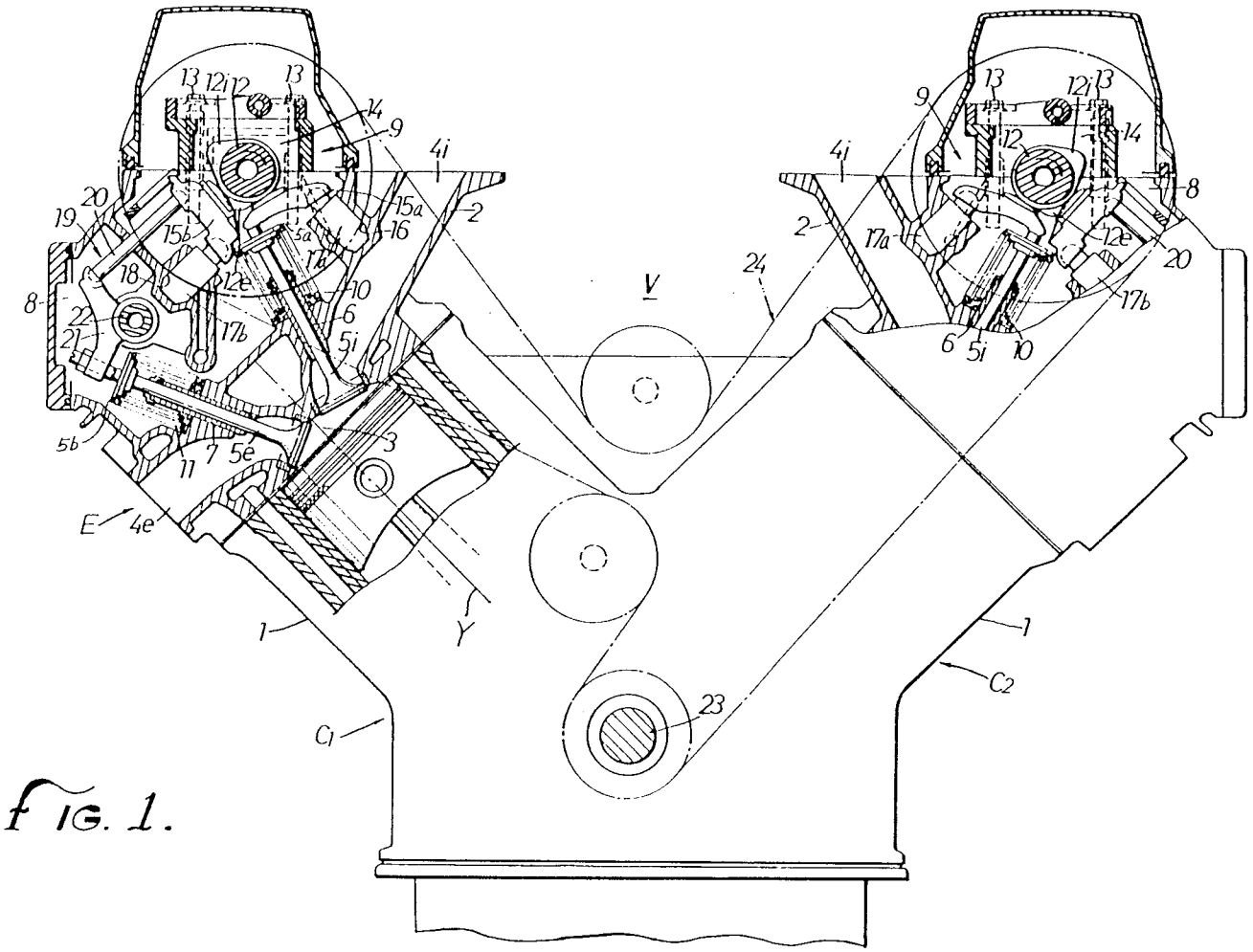
FIG. 1 is a front elevational view, partly in vertical cross section, of an internal combustion engine incorporating the camshaft support assemblies according to the present invention.

FIG. 1 shows a V-shaped multicylinder internal combustion engine E having a pair of angularly spaced cylinder blocks 1 including respective cylinder banks C1, C2 and inclined away from each other. Cylinder heads 2 are fastened respectively to the upper ends of the cylinder blocks 1.

Since the cylinder blocks 1 and the respective cylinder heads 2 are symmetrically shaped, except as described specifically below, only the cylinder block 1 and the cylinder head 2 shown on the lefthand side in FIG. 1 will be described in detail.

The cylinder head 2 has an array of combustion chambers 3 (only one shown) and intake and exhaust ports **4*i*, 4*e* opening through respective intake and exhaust openings 4*a*, 4*b* (FIG. 2) into each of the combustion chambers 3. The intake and exhaust ports 4*i*, 4*e* can be opened and closed by intake and exhaust valves 5*i*, 5*e*, respectively, slidably supported by valve guides 6, 7 mounted in the cylinder head 2. The intake and exhaust valves 5*i*, 5*e* are inclined to the axis Y of the cylinder so that the upper ends of the valves 5*i*, 5*e* are widely spaced from each other. The intake valves 5*i*** on the cylinder banks C1, C2 are positioned closer to the V-shaped valley or space V defined between the cylinder banks C1, C2.

The intake and exhaust valves **5*i*, 5*e* are operated by a valve operating mechanism 9 disposed in a chamber 8 defined in the cylinder head 2. The valve stems of the intake and exhaust valves 5*i*, 5*e* extend upwardly into the chamber 8. Valve springs 10, 11 are disposed around the valve stems and held under compression between retainers 5*a*, 5*b* and cylinder head members for normally urging the intake and exhaust valves 5*i*, 5*e* in a direction to close the intake and exhaust ports 4*i*, 4*e*. A single camshaft 12 is disposed above the intake valve 5*i* and is rotatably supported by the cylinder head 2 and a cam holder structure 14 fastened thereto by bolts 13. The camshaft 12 has a plurality of intake and exhaust cams 12*i*, 12*e* for operating the intake and exhaust valves 5*i*, 5*e*. First and second cam followers 15*a*, 15*b* are disposed underneath the camshaft 12 in a substantially V-shaped configuration and have respective upper middle slipper surfaces held in sliding contact with the intake and exhaust cams 12*i*, 12*e***, respectively, at their lower portions.

The first cam follower 15*a* has an upper end angularly movably supported by a hemispherical support end 17*c* of a first hydraulic lash adjuster 17*a* mounted in a hole 16 defined in the cylinder head 2. The lower end of the first cam follower 15*a* is held against the upper end 5*c* of the valve stem of the intake valve 5*i*.

The second cam follower 15*b* has a lower end angularly movably supported by a hemispherical support end 17*d* of a second hydraulic lash adjuster 17*b* mounted in a hole 18 defined in the cylinder head 2. The upper end of the first cam follower 15*b* acts on the upper end of the valve stem of the intake valve 5*e* through an interlink mechanism 19.

The interlink mechanism 19 comprises a pusher rod 20 having one end engaging the upper end of the second cam follower 15*b*, and a bellcrank-shaped rocker arm 21 having one end engaging the opposite end of the pusher rod 20 and the other end engaging the upper end 5*d* of the valve stem of the exhaust valve 5*e*. The rocker arm 21 is angularly movably supported by a rocker shaft 22 in the cylinder head 2.

There are as many first hydraulic lash adjusters 17*a* as the number of the intake valves 5*i*, and there are as many second hydraulic lash adjusters 17*b* as the number of the exhaust valves 5*e*. The first and second hydraulic lash adjusters 17*a*, 17*b* are positioned at spaced horizontal intervals corresponding to the cylinders of the cylinder banks C1, C2.

During operation of the engine E, the camshafts 12 in the cylinder banks C1, C2 are synchronously operated by a common crankshaft 23 through a belt-type synchronous transmission mechanism 24. As thus far described, the engine E is conventional in construction and operation.

Figure 2:
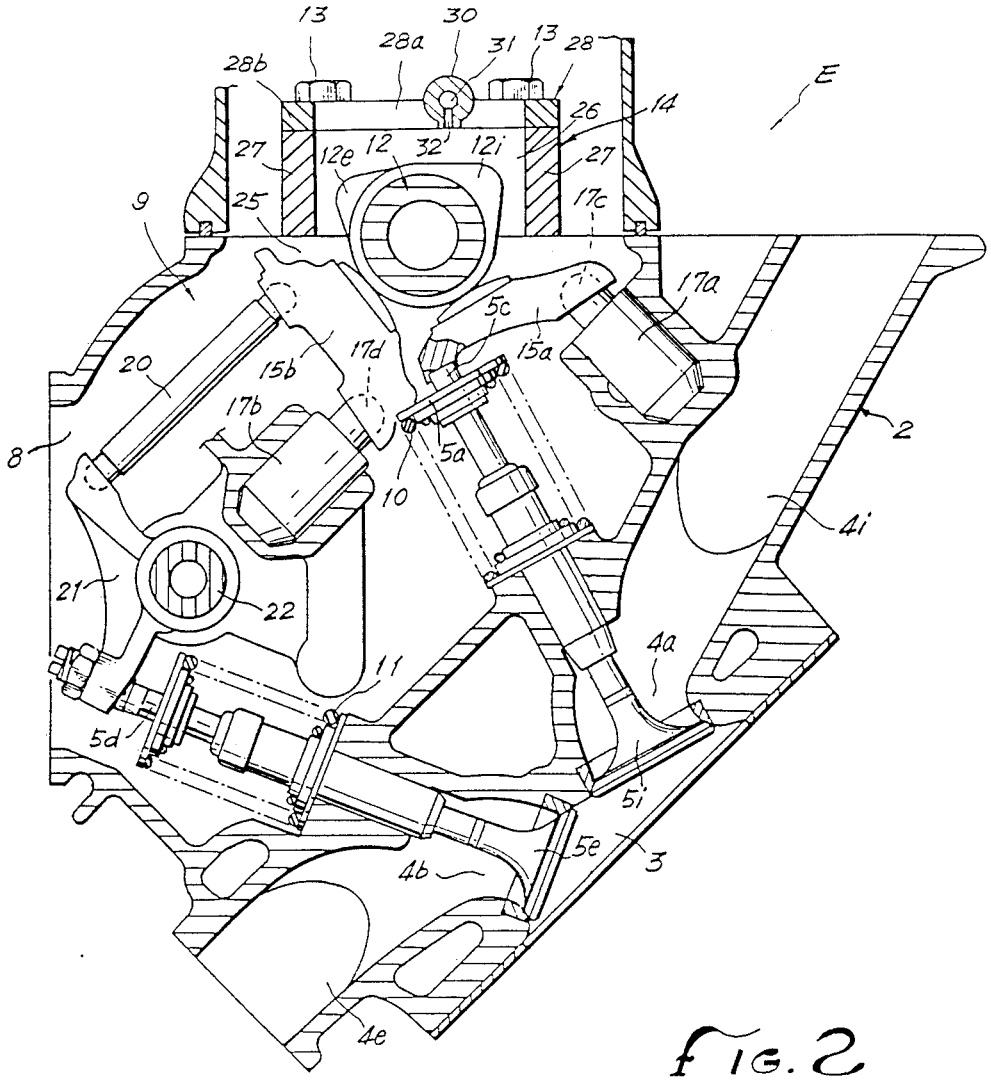
FIG. 2 is an enlarged fragmentary vertical cross-sectional view of one of the camshaft support assemblies.
Figure 3:
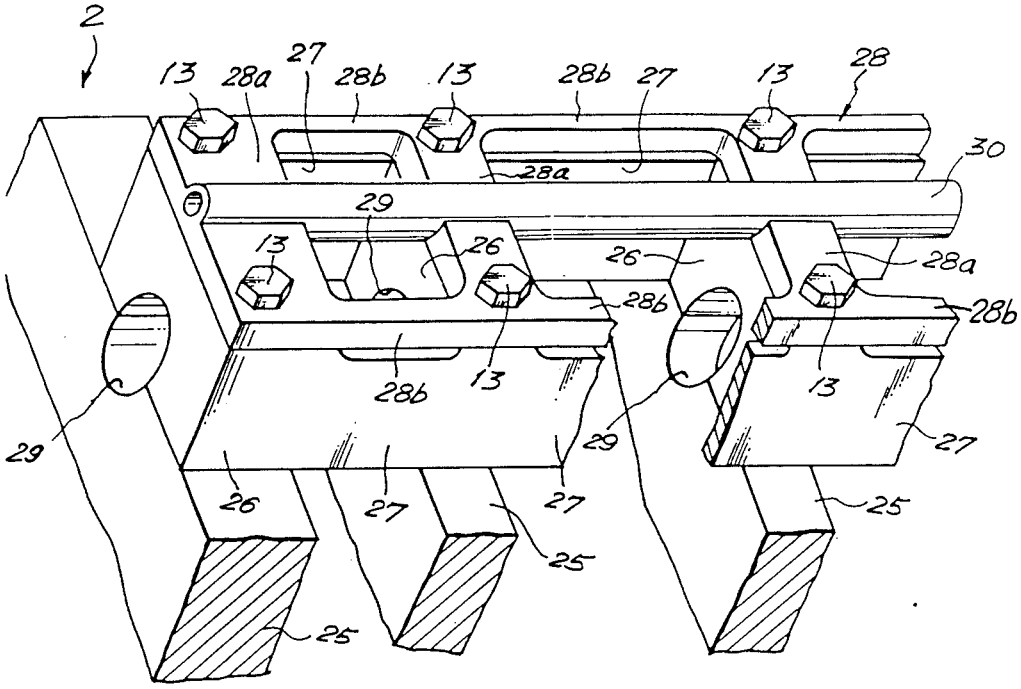
FIG. 3 is a fragmentary perspective view of the camshaft support assembly.
Figure 4:
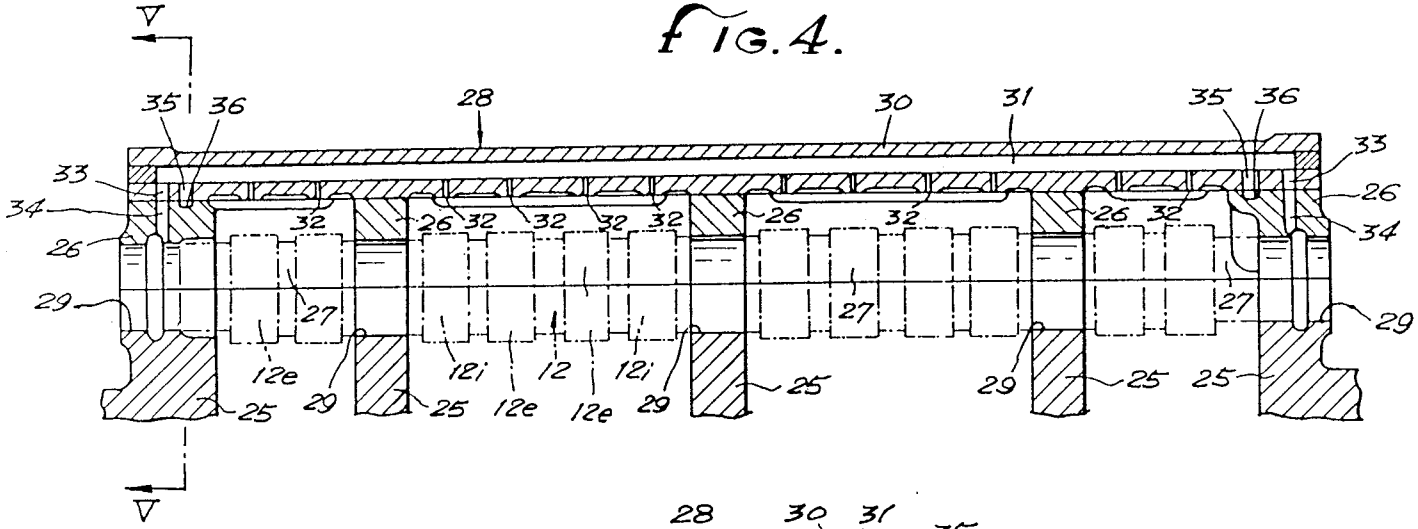
FIG. 4 is a fragmentary vertical and longitudinal cross-sectional view of the camshaft support assembly.

As illustrated in FIGS. 2 through 4, the cylinder head 2 includes a plurality of parallel, spaced bearing bases 25 formed in the cylinder head, and the cam holder structure 14 includes a like plurality of parallel, spaced cam holders 26. The camshaft 12 is rotatably supported by and between the bearing bases 25 and the cam holders 26. Due to the substantial space required for the valves and valve actuating mechanism, the bearing bases 25 and cam holders 26 are relatively thin in the axial direction of the cam.

The cam holders 26 are integrally interconnected by side walls 27 into a structurally integral unit, the side walls 27 being joined to the opposite transverse ends of the cam holders 26. An elongated rigid frame 28 is mounted on the upper surfaces of the cam holders 26 and extends across the cam holders 26. The rigid frame 28 comprises a plurality of parallel, spaced transverse frame members 28*a* aligned with and held against the upper surfaces of the cam holders 26 and a plurality of parallel, spaced longitudinal frame members 28*b* extending between the opposite ends of the transverse frame members 28*a*. The rigid frame 28 is securely fastened by the bolts 13 to the cam holders 26, which are in turn securely fastened by the bolts 13 to the bearing bases 25. Therefore, the separate cam holders 26 are firmly interconnected at their upper surfaces by the rigid frame 28. The bearing bases 25 and the cam holders 26 jointly define a plurality of circular bearing surfaces 29 therebetween by which journals of the camshaft 12 are rotatably supported.

The rigid frame 28 includes an integral oil pipe 30 extending longitudinally therealong across the transverse frame members 28*a* parallel to the longitudinal frame members 28*b* and integral with the transverse frame members 28*a*. The oil pipe 30 is rigid enough to cooperate with the longitudinal frame members 28*b* in rigidly interconnecting the cam holders 26.

With the camshaft 12 rotatably supported between the bearing bases 25 and the cam holders 26, the oil pipe 30 of the rigid frame 28 is disposed directly above and extends parallel to the camshaft 12. As best shown in FIG. 4, the oil pipe 30 has an inner oil passage 31 extending longitudinally therethrough and a plurality of oil supply ports 32 communicating with the oil passage 31 and opening substantially downwardly toward the cam surfaces of the intake and exhaust cams 12*i*, 12*e* of the camshaft 12. The oil pipe 30 also includes two oil supply ports 33 defined in its opposite ends and communicating with the oil passage 31. The oil supply ports 33 are connected to oil passages 34 defined respectively in the endmost cam holders 26 and opening at the bearing surfaces 29 in the cam holders 26.

Figure 5:
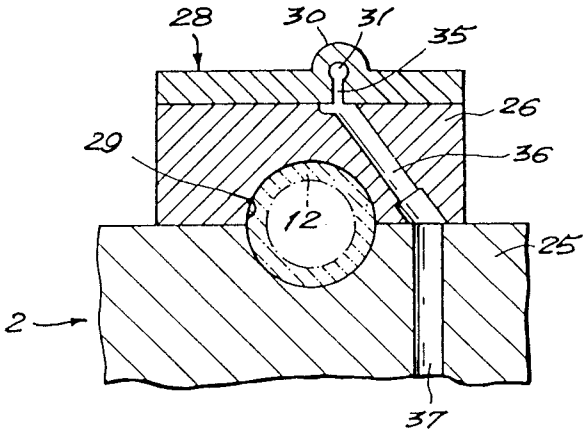
FIG. 5 is a fragmentary vertical and transverse cross-sectional view of the camshaft support assembly taken on the line V—V of FIG. 4.
Figure 6:
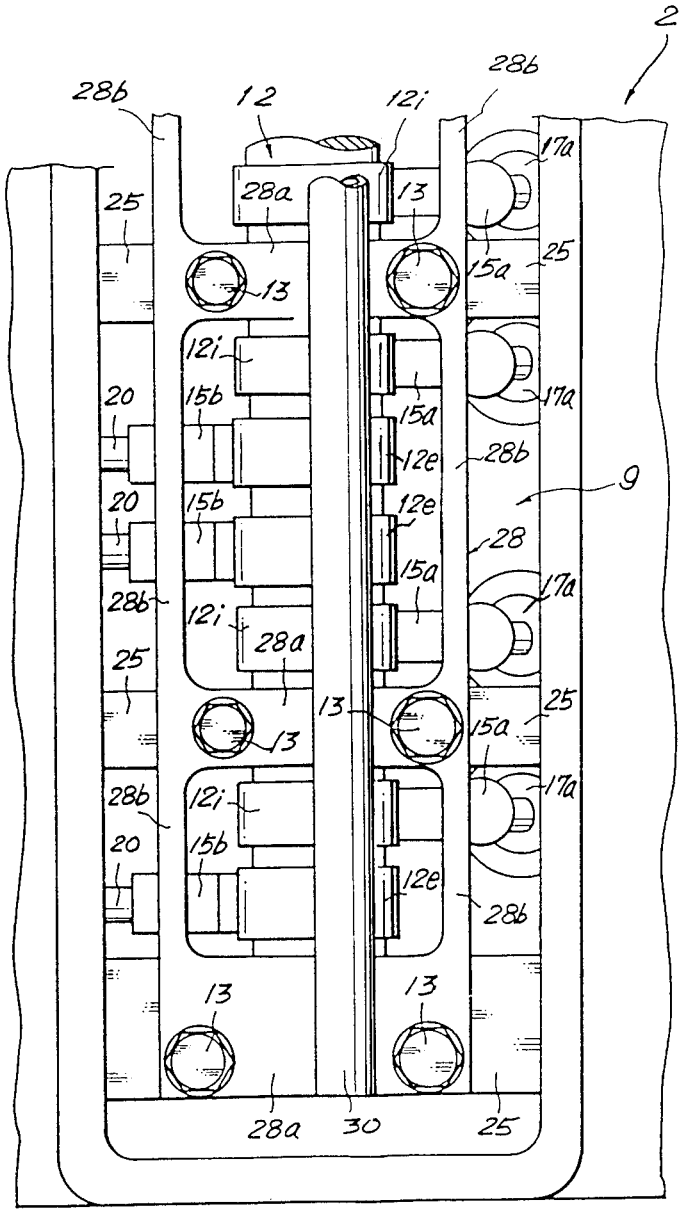
FIG. 6 is a fragmentary plan view of the camshaft support assembly.

The pipe 30 also includes two oil feed ports 35 adjacent to the oil supply ports 33, respectively, which are connected via oil passages 36 defined in the endmost cam holders 26 to an oil supply gallery 37 (FIG. 5) defined in the cylinder head 2.

Operation of the valve operating mechanism 9 as thus constructed is as follows:

During operation of the engine E, the camshaft 12 is rotated about its own axis by the crankshaft 23 through the belt-type synchronous transmission mechanism 24. As an intake stroke is started, the cam lobe of the intake cam 12*i* of the camshaft 12 slidingly contacts the cam follower 15*a* to force the latter to swing downwardly about the hemispherical support end 17*c*, pushing the valve stem of the intake valve 5*i* downwardly to cause the intake valve 5*i* to open the intake port 4*i* against the resiliency of the valve spring 10. When the intake stroke is completed, the cam lobe of the intake cam 12*i* turns past the cam follower 15*a* which then allows the intake valve 5*i* to close the intake port 4*i* under the resiliency of the valve spring 10. Similarly, as an exhaust stroke is started, the cam lobe of the exhaust cam 12*e* of the camshaft 12 slidingly contacts the cam follower 15*b* to force the latter to swing about the hemispherical support end 17*d* in a direction to push the pusher rod 20. The rocker arm 21 is now turned counterclockwise (FIG. 2) to push the valve stem of the exhaust valve 5*e* downwardly, causing the exhaust valve 5*e* to open the exhaust port 4*e* against the resiliency of the valve spring 11. When the exhaust stroke is over, the cam lobe of the exhaust cam 12*e* turns past the cam follower 15*b* which then allows the exhaust valve 5*e* to close the exhaust port 4*e* under the resiliency of the valve spring 11.

While the valve operating mechanism 9 is thus operating, the four intake and exhaust cams 12*i*, 12*e* positioned between two adjacent camshaft bearing surfaces 29 are subjected to reactive forces from the valve springs 10, 11 and stresses due to lifting movement of the hydraulic lash adjusters 17*a*, 17*b*. These forces and stresses applied to the intake and exhaust cams 12*i*, 12*e* tend to force the cam holders 26 to bend or fall over along the axis of the camshaft 12. In addition, these forces and stresses and the thermal deformation of the cylinder head 2 produce stresses tending to force the cam holders 26 out of mutual coaxial alignment. However, since the cam holders 26 are firmly interconnected at their upper surfaces by the rigid frame 28 and at the opposite ends by the side walls 27, the cam holder structure 14 is very rigid. Because the rigid cam holder structure 14 is attached to the bearing bases 25, the bearing bases 25 and hence the cylinder head 2 also are increased in rigidity to minimize any undesirable thermal or other deformation thereof. Therefore, even though each of the cam holders 26 is thin, the camshaft 12 is reliably supported for stable rotation.

While the engine E is in operation, lubricating oil is fed under pressure by an oil pump (not shown) into the oil gallery 37 in the cylinder head 2, and then delivered from the oil gallery 37 through the oil passages 36 and the oil feed ports 35 into the oil passage 31 in the oil pipe 30. The lubricating oil is then ejected downwardly from the oil passage 31 through the oil supply ports 32 onto the intake and exhaust cams 12*i*, 12*e* of the camshaft 12, and is also supplied through the oil supply ports 33 and the oil passages 34 to the camshaft bearing surfaces 29. Consequently, the intake and exhaust cams 12*i*, 12*e* and the journals of the camshaft 12 are efficiently lubricated by the lubricating oil.

Figure 7:
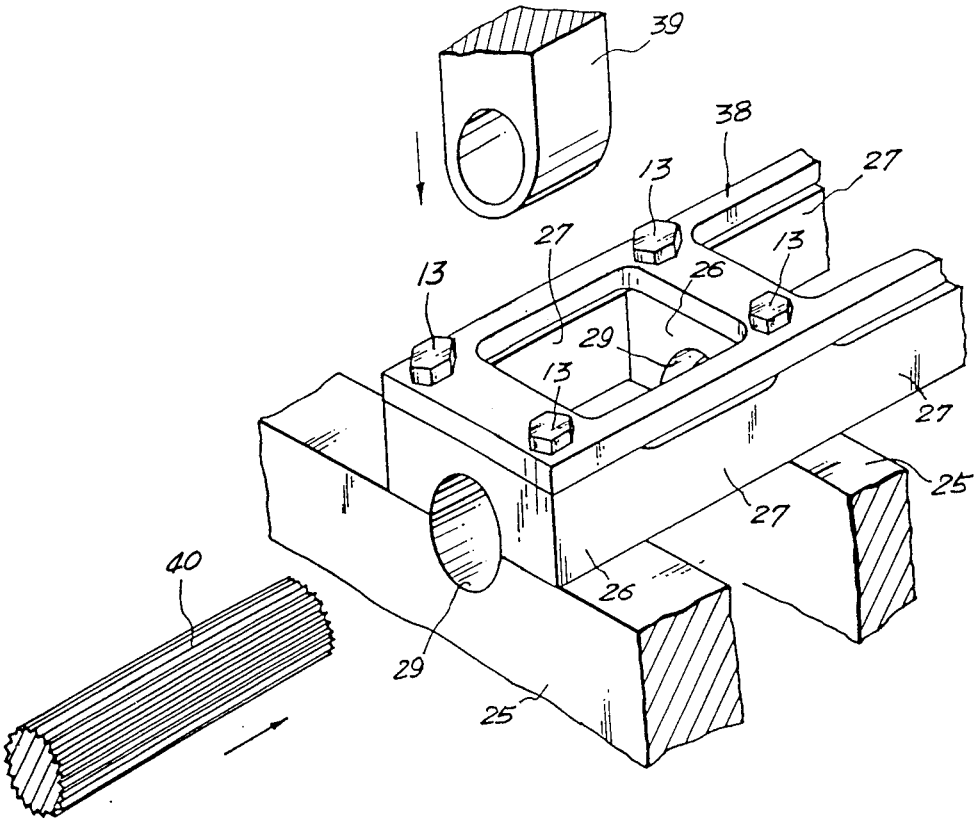
FIG. 7 is a fragmentary perspective view showing the manner in which camshaft bearing surfaces of the camshaft support assembly are finished.

During the manufacture of the valve operating mechanism 9, the camshaft bearing surfaces 29 are finished as follows: Before the rigid frame 28 is installed on the cam holders 26, a dummy frame 38 (FIG. 7) is mounted on the cam holders 26. The dummy frame 38 is similar to the rigid frame 28 except that it has no oil pipe 30. The dummy frame 38 is firmly fastened by the bolts 13 to the cam holders 36. In the absence of an oil pipe on the dummy frame 38, the spaces between the transverse frame members of the dummy frame 38 and hence the cam holders 26 are easily accessible since they are fully open upwardly. An intermediate guide bushing 39 is inserted downwardly into the space between two adjacent cam holders 26 or bearing surfaces 29, and a finishing tool 40 such as a reamer is guided by the intermediate bushing 39 while finishing the bearing surfaces 29 successively.

When all of the bearing surfaces 29 have been finished, the bolts 13 are loosened and removed to detach the dummy frame 38 and the cam holders 26. The camshaft 12 is mounted on the bearing bases 25, and the cam holders 26 and the rigid frame 28 are successively mounted in position, followed by fastening the bolts 13 to assemble the bearing bases 25, the cam holders 26, and the rigid frame 28 together to support the camshaft 12 securely.

With the arrangement shown in FIG. 3, since the cam holder assembly 14 composed of the cam holders 26 integrally united by the side walls 27 is a single piece, it can easily be handled in parts inventory control and during assembly.

FIGS. 8 and 9 show a modified camshaft support assembly according to the present invention. The camshaft support assembly of FIGS. 8 and 9 is similar to that shown in FIG. 3 except that cam holders 41 are not integrally connected to each other by any side walls, but interconnected only by the rigid frame 28. The cylinder head 2 and hence the bearing bases 25 are made of an aluminum alloy, and the cam holders 41 are made of cast iron. The rigid frame 28 which interconnects the cam holders 41 is made of an aluminum alloy. During operation of the engine, the camshaft 12 is subjected to upward forces by the cam follower 15*b* (FIG. 9), but the cam holders 41 of cast iron which bear such upward forces successfully resist elastic deformation which would otherwise be likely to occur with cam holders of an aluminum alloy. The cam holders 41 of cast iron also have the advantage that they do not thermally expand to as large an extent as cam holders of aluminum alloy, even when the bearing surfaces 29 are heated to a high temperature due to sliding contact with the camshaft 12. Therefore, any potential displacement of the bearing surfaces 29 out of mutual coaxial alignment is reduced, resulting in smoother operation and reduced noise and vibration. The bearing surfaces 29 are highly durable inasmuch as the cast iron cam holders 41 are resistant to wear. The bearing surfaces 29 are also very rigid though the entire camshaft support assembly is lightweight, because the cam holders 41 are firmly interconnected by the rigid frame 28.

Figure 10:
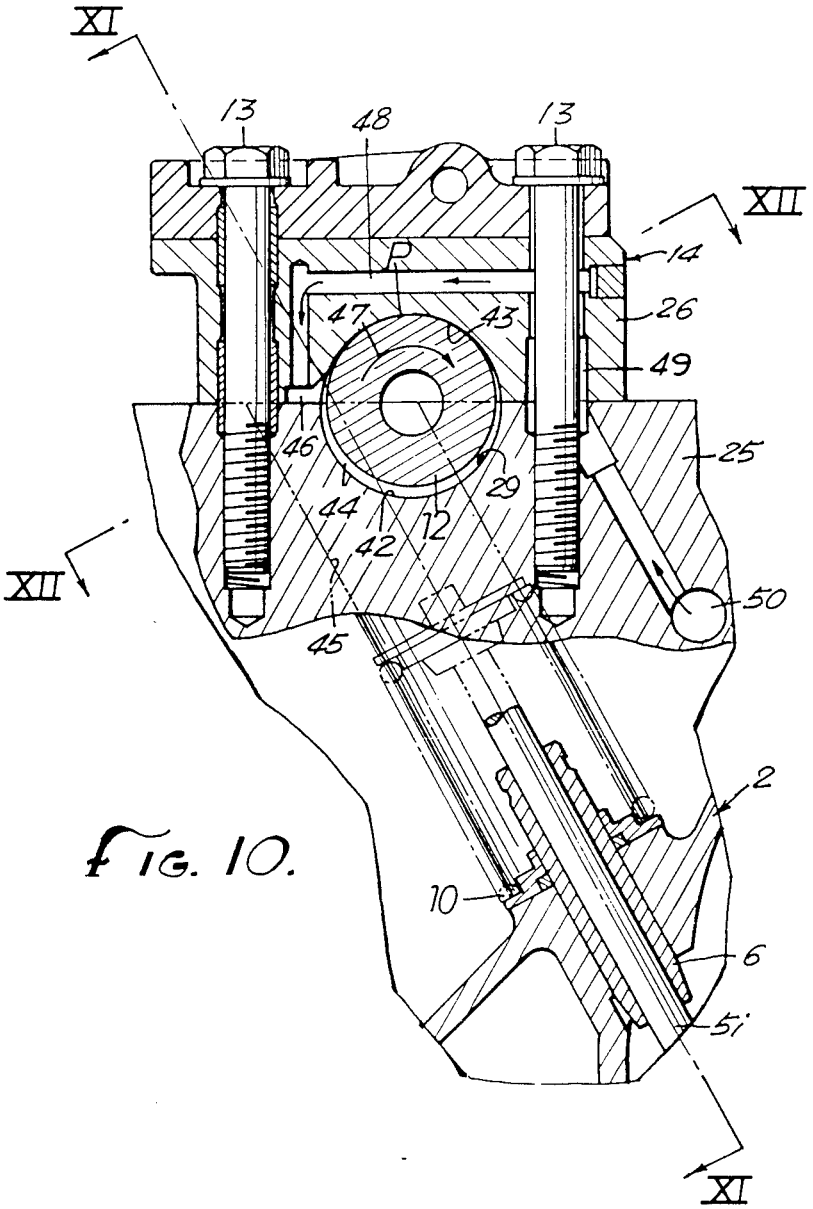
FIG. 10 is an enlarged fragmentary vertical cross-sectional view of the camshaft support assembly in one of the cylinder banks shown in FIG. 1, and showing a modified structure for lubricating each of the camshaft journals.
Figure 11:
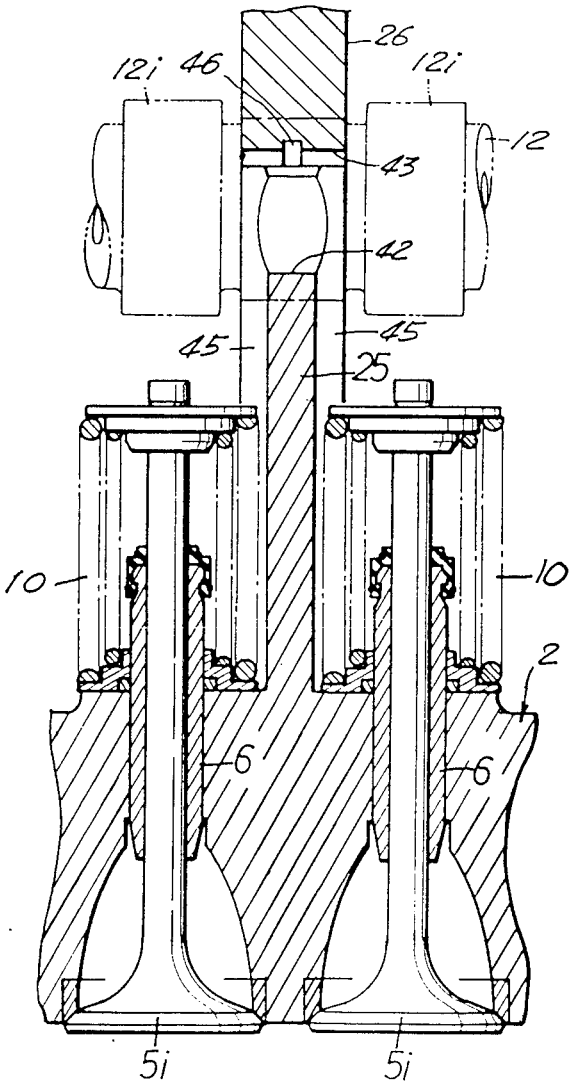
FIG. 11 is a cross-sectional view taken along the line XI—XI of FIG. 10.
Figure 12:
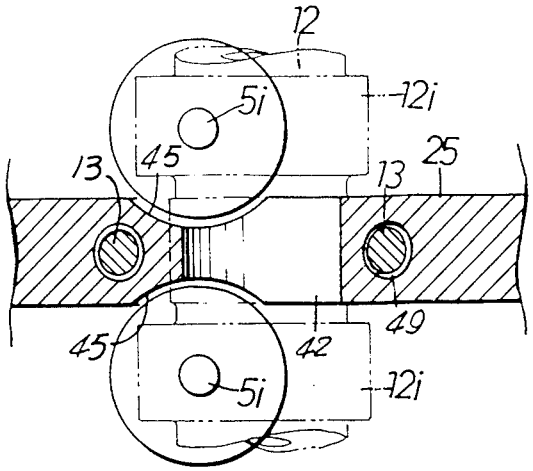
FIG. 12 is a cross-sectional view taken along the line XII—XII of FIG. 10 and with some components omitted or shown diagrammatically for clarity.

FIGS. 10 through 12 show in detail a modified structure for lubricating each of the journals of the camshaft 12 in the camshaft support assembly in the lefthand cylinder bank C1 shown in FIG. 1. As shown in FIG. 10, the bearing surface 29 is defined by and between each of the cam holders 26 and the corresponding bearing bases 25 of the lefthand cylinder head 2 and includes a first semicircular bearing surface 42 formed in the bearing base 25 and a second semicircular bearing surface 43 formed in the cam holder 26. When the intake and exhaust valves 5i, 5*e* are lifted off their seats, the camshaft 12 is urged upwardly toward the cam holders 26 by the substantial reactive forces from the valve springs 10, 11. Therefore, a relatively large gap is created between the camshaft 12 and the first bearing surface 42, thereby forming an oil space 44 therebetween, which is exaggerated in size in FIG. 10 for purposes of illustration.

As illustrated in FIGS. 11 and 12, two intake valves 5*i* are disposed one on each side of the bearing base 25. The opposite side surfaces of the bearing base 25 have recesses 45, respectively, of an arcuate cross-section, in which the valve springs 10 are partly received, so that the valve operating mechanism 9 can be made compact. The first bearing surface 42 in the bearing base 25 is partly cut away by the recesses 45, and hence has a partly reduced width along the axis of the camshaft 12. The second bearing surface 43 in the cam holder 26 has a constant full width.

The cam holder 26 has an oil supply port 46 opening into the second bearing surface 43 and positioned upstream of a location or portion P in which the camshaft 12 is pressed against the second bearing surface 43 under the resiliency of the valve springs 10, 11 and downstream of the recesses 45, with respect to the direction in which the camshaft 12 is rotated about its own axis, as shown by arrow 47. The oil supply port 46 is defined by a cavity in the surface of the cam holder 26 which is held against the bearing base 25 and also by the surface of the bearing base 25 facing the cam holder 26. The cam holder 26 also has an oil passage 48 communicating at one end with the oil supply port 46 and at the other end with an annular oil passage 49 defined in the cam holder 26 and the bearing base 25 around the bolt 13 which fastens the cam holder 26 to the bearing base 25 and which is positioned closer to the valley V (FIG. 1) of the engine E. The annular oil passage 49 is in communication with an oil supply source such as an oil pump (not shown) through an oil passage 50 defined in the bearing base 25.

Figure 13:
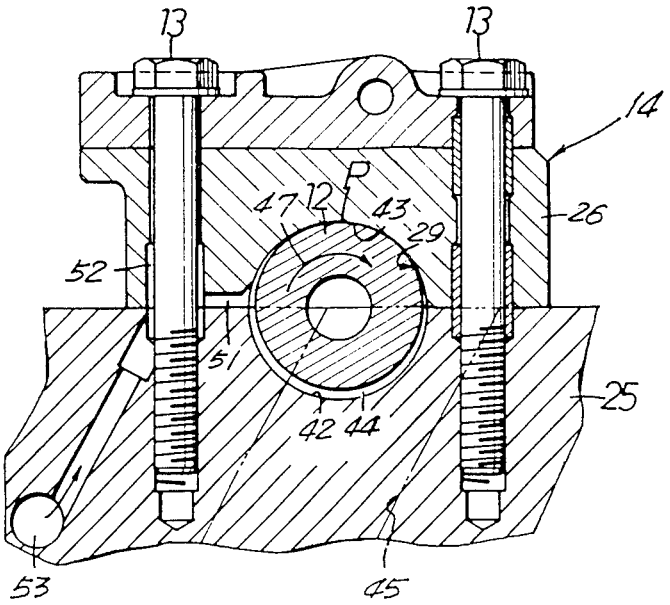
FIG. 13 is an enlarged fragmentary vertical cross-sectional view showing another structure for lubricating camshaft journals in the other cylinder bank shown in FIG. 1.

FIG. 13 shows another structure for lubricating camshaft journals in the righthand cylinder bank C2 shown in FIG. 1. An oil supply port 51 opens into the second bearing surface 43 and is positioned upstream of a location or portion P in which the camshaft 12 is pressed against the second bearing surface 43 under the resiliency of the valve springs 10, 11 and downstream of the recesses 45, with respect to the direction in which the camshaft 12 is rotated about its own axis, as shown by arrow 47. The oil supply port 51 is defined by a cavity in the surface of the cam holder 26 which is held against the bearing base 25 and also by the surface of the bearing base 25 facing the cam holder 26. The oil supply port 51 communicates with an annular oil passage 52 defined in the cam holder 26 and the bearing base 25 around the bolt 13 which fastens the cam holder 26 to the bearing base 25 and which is positioned closer to the valley V (FIG. 1) of the engine E. The annular oil passage 52 is in communication with the oil supply source through an oil passage 53 defined in the bearing base 25.

The structures for lubricating the camshaft journals in the camshaft support assemblies in the lefthand and righthand cylinder banks are asymmetrical since the camshafts 12 in both of the valve operating mechanisms 9 are rotated in the same direction as indicated by the arrows 47.

During operation of the engine E, the camshafts 12 are pressed against the cam holders 26 at the portions P under reactive forces from the valve springs 10, 11. Lubricating oil is fed from the oil supply source via the oil passages 49, 48 (in the lefthand cylinder bank) and the oil passage 52 (in the righthand cylinder bank) into the oil support ports 46, 51. Since the oil supply ports 46, 51 open into the second bearing surfaces 43 upstream of the portions P, the lubricating oil is introduced from the oil supply ports 46, 51 into a space between the camshaft 12 and the second bearing surface 43 and then forced into the P portions to lubricate the area subjected to the greatest load before the oil progresses to the oil space 44 formed at bearing surface 42. Therefore, the camshaft journals are sufficiently lubricated fully around their circumferential surfaces to ensure smooth rotation of the camshaft 12.

While the valve operating mechanism 9 shown and described herein operates pairs of intake and exhaust valves **5*i*, 5*e* with a single camshaft 12**, the principles of the present invention are applicable to other valve operating mechanisms of different overhead cam designs.

Although certain preferred embodiments have been shown and described, it should be understood that many changes and modifications may be made therein without departing from the scope of the appended claims.

What is claimed:

1. A camshaft support assembly for supporting an overhead camshaft of a valve operating mechanism in an engine, comprising:

a plurality of parallel, spaced bearing bases;

a plurality of parallel, spaced cam holders mounted respectively on said bearing bases, said bearing bases and said cam holders jointly defining a plurality of aligned bearing surfaces for rotatably supporting the overhead camshaft;

a rigid, detachable frame including a plurality of spaced, laterally tied, longitudinally elongated structural support members extending substantially parallel to said camshaft in overlying relation to said cam holders, said structural support members including an oil pipe for ejecting lubricating oil onto said camshaft; and detachable connector means for rigidly securing said frame to said cam holders for structurally interconnecting said cam holders and for fixing their position with respect to said bearing bases.

2. A camshaft support assembly according to claim 1, including a cylinder head, said bearing bases being part of said cylinder head, said cam holders being disposed on upper surfaces of said bearing bases.

3. A camshaft support assembly according to claim 1, including side walls integrally joined to opposite ends of said cam holders and interconnecting adjacent cam holders.

4. A camshaft support assembly according to claim 1, wherein said rigid frame comprises a plurality of parallel, spaced transverse frame members and a pair of parallel, spaced longitudinal frame members integrally joined to opposite ends of said transverse frame members, said oil pipe being integral with and extending across said transverse frame members parallel to said longitudinal frame members.

5. A camshaft support assembly according to claim 1, wherein said bearing bases are made of an aluminum alloy, and said cam holders are made of cast iron.

6. A camshaft support assembly according to claim 5, wherein said rigid frame is made of an aluminum alloy.

7. A camshaft support assembly according to claim 1, including intake and exhaust valves operable by said camshaft, and valve springs acting on said intake and exhaust valves for normally urging the intake and exhaust valves to apply a force on said camshaft, each of said bearing surfaces comprising a first bearing surface defined in said bearing base and a second bearing surface defined in said cam holder which is mounted on said one bearing base, each said cam holder having an oil supply port opening into said second bearing surface upstream of a portion in which said camshaft is slidingly pressed against said second bearing surface under the resiliency of said valve springs, said upstream being with respect to the direction in which said camshaft rotates about its own axis.

8. A camshaft support assembly according to claim 7, wherein each said cam holder and each said bearing base have oil passages defined therein that communicate with said oil supply port.

9. A camshaft support assembly according to claim 7, wherein each said bearing base has a pair of recesses defined in opposite side surfaces thereof, the valve springs on said intake valves being disposed one on each side of said one bearing base and partly received in said recesses, respectively.

10. A camshaft support assembly for supporting an overhead camshaft of a valve operating mechanism in an engine, comprising:

a plurality of parallel, spaced bearing bases;

a plurality of parallel, spaced cam holders mounted respectively on said bearing bases, said bearing bases and said cam holders jointly defining a plurality of aligned bearing surfaces for rotatably supporting the overhead camshaft;

intake and exhaust valves operable by said camshaft;

valve springs acting on said intake and exhaust valves for normally urging the intake and exhaust valves to apply a force on said camshaft; and each of said bearing surfaces comprising a first bearing surface defined in one of said bearing bases and a second bearing surface defined in one of said cam holders which is mounted on said one bearing base, each said cam holder having an oil supply port opening into a portion of said second bearing surface upstream with respect to the direction of rotation of the camshaft in which said camshaft is slidingly pressed against said second bearing surface under the resiliency of said valve springs.

11. A camshaft support assembly according to claim 10, wherein each said cam holder and each said bearing base have oil passages defined therein that communicate with said oil supply port.

12. A camshaft support assembly according to claim 10, wherein each said bearing base has a pair of recesses defined in opposite side surface thereof, the valve springs on said intake valves being disposed on each side of said one bearing base and partly received in said recesses, respectively.

13. A camshaft support assembly for supporting an overhead cam of a valve operating mechanism in an internal combustion engine, comprising, a plurality of spaced bearing bases, a cam holder means having a like plurality of cam holders mounted on said bearing bases, respectively, with said bearing bases and cam holders jointly defining a like plurality of bearing surfaces for rotatably supporting the overhead cam, said cam holder means including a ridid frame interconnecting the cam holders, said rigid frame having an oil pipe extending along said plurality of cam holders as a structural support member, and means for ejecting oil from the oil pipe onto the overhead camshaft.

14. The camshaft support assembly of claim 13 wherein said cam holders are separable from said rigid frame.

15. The camshaft support assembly of claim 14 wherein said cam holders are cast iron and said bearing bases, rigid frame and oil pipe are an aluminum alloy.

16. The camshaft support assembly of claim 14 wherein said plurality of cam holders are interconnected by longitudinally extending means separate from said rigid frame and oil pipe.

* * * * *